US007589430B2

(12) United States Patent
Nakamura et al.

(10) Patent No.: US 7,589,430 B2
(45) Date of Patent: Sep. 15, 2009

(54) POWER GENERATING DEVICE

(75) Inventors: Hajime Nakamura, Hyogo (JP); Shoji Yoshimura, Takasago (JP); Makoto Nakamura, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 12/013,165

(22) Filed: Jan. 11, 2008

(65) Prior Publication Data

US 2008/0174122 A1 Jul. 24, 2008

(30) Foreign Application Priority Data

Jan. 12, 2007 (JP) ..... 2007-004742

(51) Int. Cl.
*F02D 9/04* (2006.01)

(52) U.S. Cl. ..... 290/40 R; 290/40 A; 290/40 C

(58) Field of Classification Search ..... 290/40 A, 290/40 C, 40 R
See application file for complete search history.

(56) References Cited

U.S. PATENT DOCUMENTS 4,746,807 A * 5/1988 Furo et al. ..... 290/40 C
5,642,006 A * 6/1997 Cech ..... 307/87

FOREIGN PATENT DOCUMENTS

| | | |
|---|---|---|
| JP | 2004-100657 | 4/2004 |
| JP | 2005-176496 | 6/2005 |
| JP | 2006-2576 | 1/2006 |

* cited by examiner

*Primary Examiner*—Nicholas Ponomarenko
*Assistant Examiner*—Iraj A Mohandesi
(74) *Attorney, Agent, or Firm*—Oblon, Spivak, McClelland, Maier & Neustadt, P.C.

(57) ABSTRACT

A power generating device according to the present invention has a positive displacement steam expander for converting expansion of steam into a rotational force, a power generator connected to a rotational axis of the positive displacement steam expander, an inverter for setting an operational frequency of the power generator, a power detector for detecting generated electric power of the power generator, and control means for changing set frequency of the inverter in accordance with a deviation of the generated electric power detected by the power detector from a target value. According to such a configuration, it is possible to sustain high output of the power generator irrespective of a differential pressure between primary side steam and secondary side steam.

9 Claims, 2 Drawing Sheets

POWER GENERATING DEVICE

BACKGROUND OF THE INVENTION

1. Field of the Invention

The present invention relates to a power generating device.

2. Description of the Related Art

A power generating device for driving a power generator by rotating a turbine with steam is widely used. Secondarily utilizing low pressure steam discharged from the turbine is disclosed in Japanese Patent Laid-Open Nos. 2006-2576 and 2004-100657. In the power generating device in which the turbine is used, it is difficult to control pressure of the low pressure steam discharged from the turbine.

A possibility of utilizing a positive displacement steam expander such as a screw expander is examined. The positive displacement steam expander has a flat characteristic that torque is determined on the basis of not a rotation speed but a difference between a supply pressure and a discharge pressure, and a flow rate of steam is proportional to the rotation speed.

Output of the positive displacement steam expander is represented by the product of the torque and the rotation speed. In a design of the power generating device, the power generator is selected so as to maximize a differential pressure between the supply pressure and the discharge pressure of the steam, and obtain rated output at the time of operating with a rated frequency.

In accordance with an operating state of equipments demanding low pressure steam in secondary side of the power generating device, or an operating state of devices arranged in parallel to the power generating device and utilizing the steam, there is sometimes a case where a pressure of the secondary side steam is increased and the differential pressure in the positive displacement steam expander is decreased so that the output of the power generator is lowered.

With regard to the frequency of the power generating device, for example Japanese Patent Laid-Open No. 2005-176496 describes a technique of controlling the rotation speed of the turbine by setting the frequency of the power generator.

SUMMARY OF THE INVENTION

In consideration to the problems mentioned above, it is an object of the present invention to provide a power generating device capable of sustaining high output of a power generator irrespective of a differential pressure between primary side steam and the secondary side steam.

In order to achieve the object mentioned above, a power generating device according to the present invention comprises a positive displacement steam expander for converting expansion of steam into a rotational force, a power generator connected to a rotational axis of the positive displacement steam expander, power generator operational frequency setting means for setting an operational frequency of the power generator, a power detector for detecting generated electric power of the power generator, and control means for changing set frequency of the power generator operational frequency setting means in accordance with a deviation of the generated electric power detected by the power detector from a target value.

According to the above configuration, by increasing the rotation speed of the positive displacement steam expander in the case of low output of the power generator, it is possible to increase the output without changing output torque. Therefore, it is preferable that the control means performs negative feedback to the set frequency of the power generator operational frequency setting means in accordance with the deviation of the generated electric power from the target value.

In the power generating device according to the present invention, when the target value is rated output of the power generator, it is possible to exhibit a maximum ability of the power generator.

In the power generating device according to the present invention, when the positive displacement steam expander is a screw expander, it is possible to obtain a desired flat output characteristic.

When the power generating device according to the present invention further comprises a frequency converter for converting a frequency of the generated electric power of the power generator into a utility frequency, it is possible to supply the generated electric power to an electric power system which is generally usable.

In the power generating device according to the present invention, when the power generator operational frequency setting means changes a frequency of field current of the power generator, it is possible to properly control the rotation speed of the positive displacement steam expander.

According to the present invention, by controlling the rotation speed of the power generator, it is possible to change the rotation speed without changing the torque of the positive displacement steam expander, and sustain the generated electric power to the target value. Thereby, it is possible to exhibit the maximum ability of the power generator irrespective of a pressure of the secondary side steam of the positive displacement steam expander.

DESCRIPTION OF THE PREFERRED EMBODIMENTS

A description will be given to embodiments of the present invention with reference to the drawings.

Figure 1:
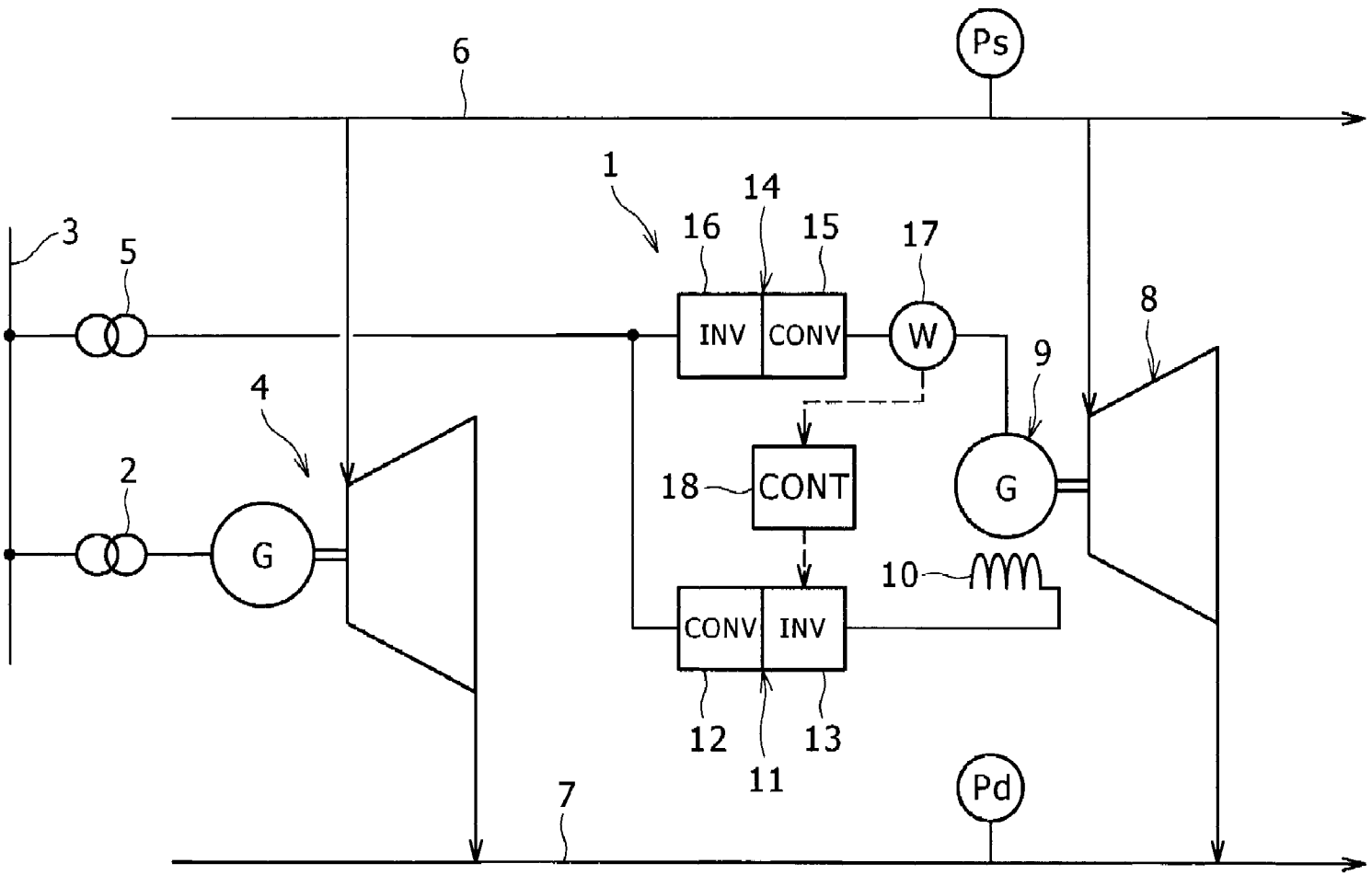
FIG. 1 is a schematic view of a power generating device according to a first embodiment of the present invention.

FIG. 1 shows a power generating system including a power generating device 1 according to a first embodiment of the present invention. The power generating device 1 is supplementary power generating equipment which is installed in parallel to a main power generating device 4 with large capacity for supplying electric power to an electric power system 3 through an interconnecting transformer 2, and capable of supplying the electric power to the electric power system 3 through an interconnecting transformer 5.

High pressure steam of a predetermined pressure Ps (for example, 1.6 MPa) is supplied from a high pressure steam header 6 to the main power generating device 4. The main power generating device 4 converts energy of the high pressure steam into a rotational force so as to generate the electric power, and discharges the steam in which the energy is consumed and the pressure is decreased (for example, 0.1 to 0.8 MPa) to a low pressure steam header 7. Remaining energy of the low pressure steam discharged to the low pressure steam header 7 is secondarily utilized in the demanding equipment (not shown).

The high pressure steam is supplied from the high pressure steam header 6 to the power generating device 1. The power generating device 1 has a screw expander 8 serving as a positive displacement steam expander for converting expansion of the high pressure steam into the rotational force, and a power generator 9 of a synchronous type connected to a rotational axis of the screw expander 8. The steam discharged from the screw expander 8 is introduced to the low pressure steam header 7 like the main power generating device 4 in order to secondarily utilize the steam.

A frequency of current supplied from the electric power system 3 through the interconnecting transformer 5 is converted into an arbitrary frequency by a field frequency convertor 11, and the current is inputted to a field winding wire 10 of the power generator 9. The field frequency convertor 11 includes a converter 12 for rectifying the supplied current with a utility frequency, and an inverter 13 for switching the output of the converter 12 by a semiconductor and converting the output to alternating current with a desired frequency.

A rotor of the power generator 9 is rotated in synchronization with the field current impressed by the field winding wire 10, and generates the electric power with the same frequency as the field current. That is, an operational frequency of the power generator 9 is determined on the basis of a set frequency of the inverter 13.

The generated electric power of the power generator 9 is converted into the utility frequency by an output frequency converter 14, and introduced to the electric power system through the interconnecting transformer 5. As well as the field frequency converter 11, the output frequency converter 14 is formed by a converter 15 and an inverter 16. An electric power value W of the generated electric power of the power generator 9 is detected by a power detector 17, and inputted to a controller (control means) 18. The controller 18 is to control the set frequency of the inverter 13 on the basis of the generated electric power W of the power generator 9. That is, in the present embodiment, the inverter 13 and the controller (control means) 18 mainly play a role of power generator operational frequency setting means.

When efficiency of the power generator 9 and the screw expander 8 is constant, the generated electric power W of the power generator 9 is represented by the following expression taking the rotation speed of the screw expander 8 as N. κ is ratio of specific heat of steam. a is constant.

$$W = \frac{aPsN}{\kappa - 1}\left[1 - \left(\frac{Pd}{Ps}\right)^{(\kappa-1)\kappa}\right] \quad \text{[Expression 1]}$$

As shown in the expression, the generated electric power W is proportional to the rotation speed N, and increased as a discharge pressure Pd is decreased. Although the rotation speed N is proportional to the set frequency of the inverter 13, the discharge pressure Pd of the screw expander 8 is a pressure of the low pressure steam header 7 and depends on a discharge pressure of the main power generating device 4 with large capacity.

It should be noted that as the power generator 9 according to the present embodiment, a power generator capable of generating the electric power of the rated output with the rated frequency when the discharge pressure Pd is minimum (for example, 0.1 MPa) and a differential pressure between the primary side steam and secondary side steam is maximum is selected.

The controller 18 performs negative feedback to the set frequency of the inverter 13 on the basis of a deviation between a target value Ws and the generated electric power W (W−Ws) taking the rated output of the power generator 9 as the target value Ws. For example, the controller 18 performs PID control of adding a value obtained by multiplying the deviation between the generated electric power W and the target value Ws (W−Ws) by a negative constant, a value obtained by multiplying an integrated value of the deviation (W−Ws) by a negative constant, and a value obtained by multiplying a differentiated value of the deviation (W−Ws) by a negative constant to the set frequency of the inverter.

Thereby, in the case where the discharge pressure Pd of the screw expander 8 is increased, that is, the differential pressure between the primary side steam pressure Ps and secondary side steam pressure Pd generating the torque of the screw expander 8 is decreased, the power generating device 1 increases the rotation speed N of the screw expander 8 and the generated electric power W of the power generator 9 is sustained to the rated output Ws.

The primary side steam pressure Ps supplied from the high pressure steam header 6 is invariable since the primary side steam pressure Ps is determined by a steam supplying system such as a boiler. The power generator 9 is to generate the electric power of the rated output with the rated frequency in the case of the minimum discharge pressure Pd. Therefore, when the generated electric power W is sustained to the rated value Ws, the operational frequency of the power generator 9 is always maintained to the rated frequency or more. In an inductive electric machine such as the power generator, when the operational frequency is decreased, impedance is lowered so as to easily cause overload. However, in the present embodiment, since the power generator 9 is always operated with the rated frequency or more, the impedance is not lowered and the overload is not caused by generating the electric power of the rated output.

As a matter of course, the power generating device 1 according to the present invention is capable of sustaining the generated electric power W of the power generator to the rated value Ws so as to prevent a decrease in the output even in the case where the primary side steam pressure Ps is changed.

In general, when the operational frequency of the power generator 9 is a high frequency which is close to the rated frequency, a possibility that the operational frequency is once radically decreased in accordance with a situational change is increased. When the operational frequency is radically decreased, the impedance of the power generator is lowered and excessive current is generated, that is, the overload is caused. Therefore, in the case where the power generator 9 is operated with the high operational frequency which is close to the rated frequency, a measure for preventing the overload due to the decrease in the operational frequency is desirably taken. The measure includes performing a "prevention of overload by detecting current" by installing an over current relay, and a "prevention of overload by detecting temperature" by installing a thermostat.

Figure 2:
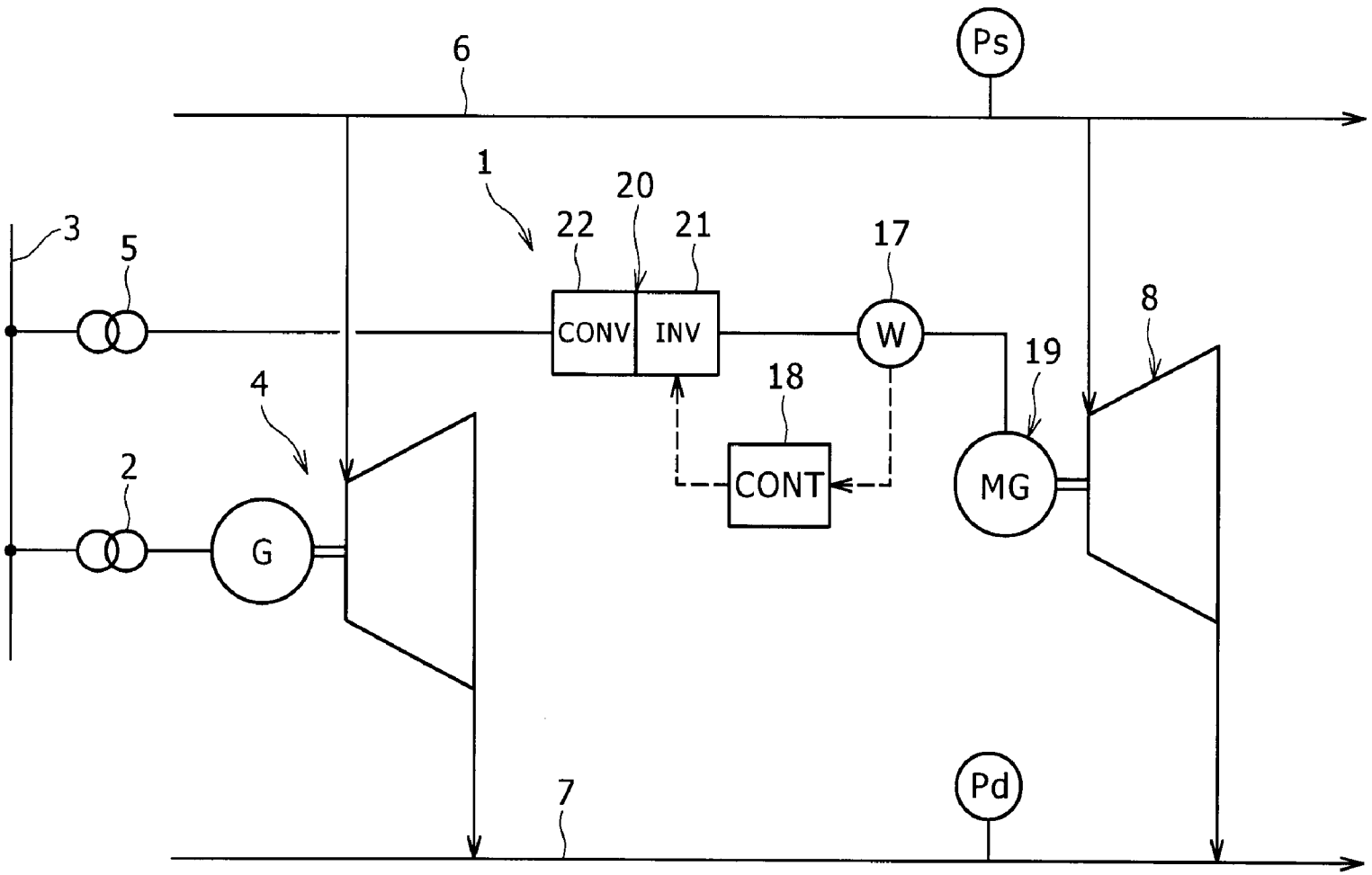
FIG. 2 is a schematic view of a power generating device according to a second embodiment of the present invention.

FIG. 2 shows a power generating device 1 according to a second embodiment of the present invention. In the present embodiment, the same reference numerals are given to the same constituent elements as in the first embodiment, and an explanation thereof will be omitted. As a power generator 19 according to the present embodiment, a motor generator capable of switching between a so-called power running operation and a regenerating operation is adopted.

To the power generator 19, an output frequency converter 20 is connected. The output frequency converter 20 is formed by an inverter 21 and a converter 22. Both the inverter 21 and the converter 22 are formed by a so-called three phases half-bridge circuit including diodes connected in series and switching elements connected in parallel to the half-bridge circuit such as IGBT although the half-bridge circuit and the switching elements are not shown in the figure.

As mentioned above, the power generator 19 is the motor generator capable of switching between the power running operation and the regenerating operation. The inverter 21 and the converter 22 connected to the power generator 19 are capable of switching between a function as an reverse conversion circuit (inverter in a limited sense) for generating alternating current power from direct current power and a function as a rectification circuit (converter in a limited sense) for generating the direct current power from the alternating current power. That is, when the power generator 19 is used for the power running operation (or operated as a motor), the inverter 21 performs the function as the reverse conversion circuit (inverter in a limited sense) for generating the alternating current power from the direct current power and at the same time, the converter 22 performs the function as the rectification circuit (converter in a limited sense) for generating the direct current power from the alternating current power. When the power generator 19 is used for the regenerating operation (or operated as the power generator), the function of the inverter 21 and the function of the converter 22 are reversed.

The controller (control means) 18 transmits a gate signal in which pulse width is modulated to the switching elements of the inverter 21 mentioned above so as to perform proper switching. Thereby, all the generated torque of the power generator 19 can be controlled, and then the rotation speed of the power generator 19 can be controlled. That is, in the present embodiment, the inverter 21 and the controller 18 mainly play a role of the power generator operational frequency setting means.

It should be noted that the present invention is not limited to the embodiments mentioned above. For example, instead of the output frequency converter 20 in the power generating device 1 according to the second embodiment of the present invention, a matrix converter may be adopted. In comparison to the converter and the inverter for converting the alternating current to the direct current and then converting the direct current to the alternating current again, the matrix converter for directly converting the alternating current to the alternating current is advantageous in terms of small size, light weight and high efficiency.

The power generating device according to the present invention is not limited to the case where the power generating device is installed in parallel to a main power generating device with large capacity. The power generating device according to the present invention may be used alone.

We claim:

1. A power generating device, comprising:

a positive displacement steam expander for converting expansion of steam into a rotational force;

a power generator connected to a rotational axis of said positive displacement steam expander;

power generator operational frequency setting means for setting an operational frequency of said power generator;

a power detector for detecting generated electric power of said power generator; and control means for changing a set frequency of said power generator operational frequency setting means in accordance with a deviation of the generated electric power detected by said power detector from a target value, wherein the target value of the generated electric power is the rated output of said power generator.

2. The power generating device according to claim 1, wherein said control means performs negative feedback to the set frequency of said power generator operational frequency setting means in accordance with the deviation of the generated electric power from the target value.

3. The power generating device according to claim 1, wherein said positive displacement steam expander is a screw expander.

4. The power generating device according to claim 1, further comprising:

a frequency converter for converting a frequency of the generated electric power of said power generator into a utility frequency.

5. The power generating device according to claim 1, wherein said power generator operational frequency setting means is to change a frequency of field current of said power generator.

6. A power generating device, comprising:

a positive displacement steam expander for converting expansion of steam into a rotational force;

a power generator connected to a rotational axis of said positive displacement steam expander;

power generator operational frequency setting means for setting an operational frequency of said power generator;

a power detector for detecting generated electric power of said power generator; and control means for changing a set frequency of said power generator operational frequency setting means in accordance with a deviation of the generated electric power detected by said power detector from a target value, wherein said power generator operational frequency setting means is to change a frequency of field current of said power generator.

7. The power generating device according to claim 6, wherein said control means performs negative feedback to the set frequency of said power generator operational frequency setting means in accordance with the deviation of the generated electric power from the target value.

8. The power generating device according to claim 6, wherein said positive displacement steam expander is a screw expander.

9. The power generating device according to claim 6, further comprising:

a frequency converter for converting a frequency of the generated electric power of said power generator into a utility frequency.

* * * * *